United States Patent [19]

Silence et al.

[11] 4,156,857

[45] May 29, 1979

[54] METHOD OF REDUCING SPURIOUS SIGNAL GENERATION IN PASSIVE MICROWAVE COMPONENTS

[75] Inventors: Neal C. Silence, Torrance; Juri G. Leetmaa; Charles F. Montgomery, both of Los Angeles, all of Calif.

[73] Assignee: Hughes Aircraft Company, Culver City, Calif.

[21] Appl. No.: 793,209

[22] Filed: May 2, 1977

[51] Int. Cl.[2] ..... H01P 1/00

[52] U.S. Cl. ..... 333/12; 324/57 N; 324/58 R; 333/245

[58] Field of Search ..... 324/57 N, 58 R, 58 A, 324/58 B; 333/12, 76, 78, 97 R

[56] References Cited

U.S. PATENT DOCUMENTS

| | | | |
|---|---|---|---|
| 3,219,951 | 11/1965 | Clark | 333/97 R |
| 3,386,054 | 5/1968 | Spikula | 324/58 B X |
| 3,882,427 | 5/1975 | Pflanz | 333/12 |

*Primary Examiner*—Paul L. Gensler

*Attorney, Agent, or Firm*—John Holtrichter, Jr.; W. H. MacAllister

[57] ABSTRACT

A method of eliminating a substantial portion of the nonlinear effects that occur in passive microwave devices operating under relatively high power conditions by use of small lightweight permanent magnets about the device structure while monitoring the level of such undesired signals.

2 Claims, 3 Drawing Figures

METHOD OF REDUCING SPURIOUS SIGNAL GENERATION IN PASSIVE MICROWAVE COMPONENTS

BACKGROUND OF THE INVENTION

The background of the invention will be set forth in two parts.

1. Field of the Invention

This invention relates to microwave systems and more particularly to passive components utilized at relatively high signal levels.

2. Description of the Prior Art

It has been observed that various components of a microwave system which are normally considered to be passive can exhibit nonlinear effects at high signal levels. This was brought out, for example, in an article by R. D. Cox entitled "Measurements of Waveguide Component and Joint Mixing Products in 6 GHz Frequency Diversity Systems", in IEEE Transactions on Communication Techniques, Vol. COM - 18, No. 1, February 1970, pp. 33–37.

These effects are manifest in the generation of intermodulation products and/or the generation of harmonics. Even though the levels of the signals generated are usually very low, they may create severe interference problems in high sensitivity systems that are presently in use or being designed. Up until the present discovery, these nonlinear effects have been considered to be primarily caused by a small but finite nonlinear impedance occuring at mechanical junctions within the microwave device. Other sources of spurious signal generation that have been considered are gaseous condition, thermal condition modulation and thermoelectric junctions. Numerous assembly and fabrication techniques have been employed with moderate success to minimize the generation of these spurious signals.

In contrast to the direction taken in the prior art to overcome this serious problem, the invention recognizes the source of spurious signal generation as the interaction of the local r.f. magnetic fields with the magnetic moments associated with the atoms of the various metals used in fabricating the r.f. structures.

It should, therefore, be evident that a new technique which was not heretofore contemplated in solving this longstanding serious problem would constitute a significant advancement in the prior art.

SUMMARY OF THE INVENTION

In view of the foregoing factors and conditions characteristic of the prior art, it is a primary object of the present invention to provide new and improved techniques to significantly reduce the generation of intermodulation products and/or the generation of harmonics in passive components of a microwave system operating at relatively high signal levels.

It is another object of the present invention to provide a highly effective, yet simple, method for significantly reducing the generation of spurious signals in high power microwave devices which may be optimized while monitoring the system for spurious signal generation.

In accordance with the present invention, a method for reducing the generation of intermodulation and/or harmonics includes the steps of; (1) introducing a relatively high power microwave r.f. signal to a passive microwave component, (2) monitoring the level of spurious signal generation, (3) deploying at least one permanent magnet about the structure of the microwave component while monitoring said level of spurious signal generation and (4) affixing said permanent magnet to said structure at a location providing the lowest level of said spurious signal generation.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENT

Figure 1:
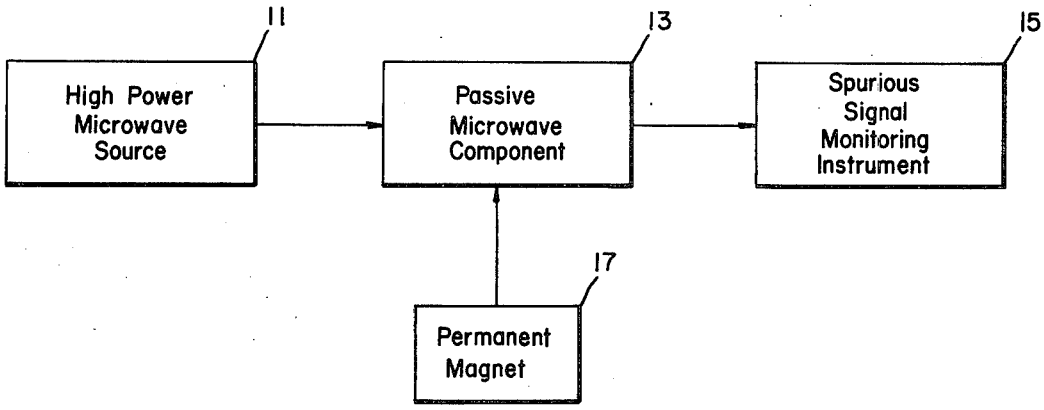
FIG. 1 is a block diagram illustrating a method of reducing spurious signal generation in passive microwave components in accordance with the present invention.

Referring now to the block diagram of FIG. 1, there is shown a new technique for significantly reducing the generation of intermodulation and/or harmonics in passive microwave components operating under relatively high r.f. power conditions. The method illustrated by this diagram will now be set forth.

As noted previously, a consideration which was not seriously considered as a source of spurious signal generation is the interaction of the local r.f. magnetic fields with the magnetic moments associated with the atoms of the various metals making up a passive microwave component. One of the stronger of this class of interactions is that associated with ferromagnetic resonance, a detailed description of which phenomenon is extensively described in such published books as "Magnetism", by T. G. Rado and H. Suhl, Vol. I, Academic Press, N.Y. 1963; and "Microwave Ferrites and Ferromagnetics", by B. Lax and K. J. Button, McGraw-Hill, N.Y., 1962. The conditions under which the interaction may take place in microwave devices is such that harmonics and intermodulation products may be generated. On the subject of harmonic generation, attention is drawn to page 657 of the Rado, et al book, and to page 637 of the Lax, et al publication.

The invention focuses on this class of phenomena which is dependent upon the magnitude of a static magnetic field (generated internally or externally), whereby the generation of harmonics and other spurious signals by this effect is minimized through the use of appropriately placed magnets. The steps include the coupling of a relatively high power source 11 of microwave energy to a passive microwave component 13, and while monitoring the output signal from the latter component with an appropriate instrument 15 capable of detecting and measuring the magnitude of spurious signals, deploying one or more permanent magnets 17 about the passive device structure until a minimum level of spurious signals is provided. At this point, the magnet or magnets, are permanently affixed to the structure.

Figure 2:
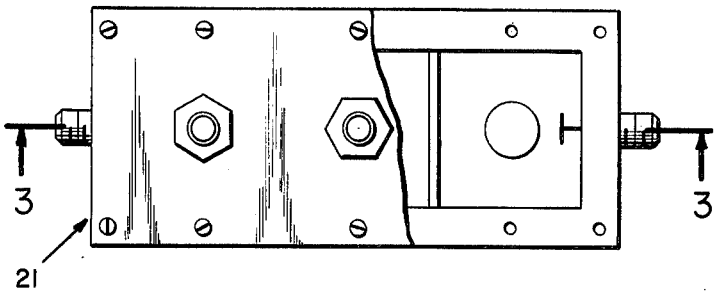
FIGS. 2 and 3 are respectively top plan view and a sectional, side elevational view of a passive microwave component utilizing the method of reducing spurious signal generation in accordance with the present invention.
Figure 3:
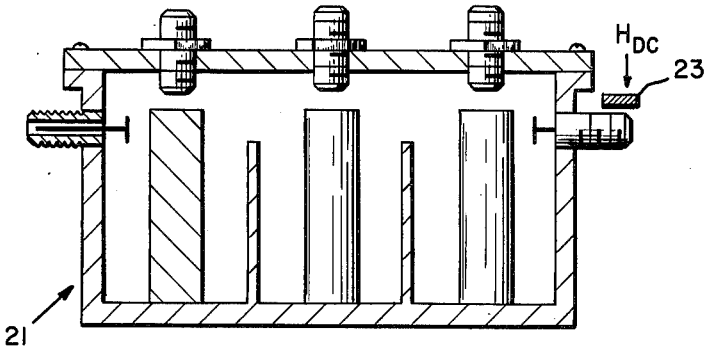

FIGS. 2 and 3 illustrate a conventional three section reentrant coaxial cavity filter 21 which has been constructed for operation at a fundamental frequency of about 200 MHz. The measured attenuation at the second harmonic of this filter was at first found to be 100 dB. However, when a high power source having an output power of +47 dBm and −28 dBm at the fundamental and second harmonic frequencies, respectively, was coupled to the filter, the output of the second harmonic frequency from the filter 21 was about −60 dBm and not −128 dBm, as would otherwise have been expected. Utilizing additional conventional techniques to reduce harmonic generation at various junctions within the filter improved the second harmonic response to only about −70 dBm. However, applying small magnets 23 near the standard "non-magnetic" stainless steel coax connectors in accordance with the method of invention, easily improved the response to −90 dBm. Further adjustments in the placement of the magnets provided a response of less than −110 dBm, which was the sensitivity limit of the measurement system used.

From the foregoing it should be evident there has been described a technique utilizing relatively small lightweight permanent magnets to eliminate a substantial portion of the nonlinear effects that occur in microwave devices that have been previously considered passive. Also, it has been shown that by the appropriate introduction of materials that introduce the electron spin resonance type of phenomena into the circuit, the generation of spurious signals may be "tuned out" through adjustment of a static magnetic field.

What is claimed is:

1. The method of reducing spurious signal generation in passive microwave components under relatively high power conditions, comprising the steps of:

introducing a level of microwave signal to a passive microwave component sufficient to cause the generation of a spurious signal;

deploying at least one external discrete permanent magnet on the surface of said microwave component while monitoring the spurious signal level detected; and affixing said permanent magnet to said structure at a position providing the lowest level of said spurious signal at the output of said component.

2. A microwave structure, including a passive microwave component that causes the generation of a spurious signal when in the presence of a sufficient level of microwave signal energy, compising:

a microwave structure;

a passive component mounted on said structure; and at least one discrete permanent magnet externally attached to said component at a position providing the lowest level of spurious signal generation.

* * * * *